United States Patent [19]

Knarvik

[11] Patent Number: 4,970,825

[45] Date of Patent: Nov. 20, 1990

[54] COLLAPSING MECHANISM FOR REVOLVING DOORS

[75] Inventor: Andrew A. Knarvik, Vernon Hills, Ill.

[73] Assignee: Crane Fulview Door Company, Lake Bluff, Ill.

[21] Appl. No.: 493,430

[22] Filed: Mar. 14, 1990

[51] Int. Cl.[5] ..... E05D 15/02

[52] U.S. Cl. ..... 49/44

[58] Field of Search ..... 49/42, 43, 44; 109/8

[56] References Cited

U.S. PATENT DOCUMENTS

| | | | |
|---|---|---|---|
| 1,134,325 | 4/1915 | Flint | 49/42 |
| 1,278,145 | 9/1918 | Haviland | 49/42 |
| 1,952,393 | 3/1934 | Tigue | 109/8 |
| 1,963,881 | 6/1934 | Blanchard | 49/44 |
| 4,627,193 | 12/1986 | Schwarz | 49/44 X |
| 4,796,542 | 1/1989 | Lee | 49/42 X |

*Primary Examiner*—Philip C. Kannan
*Assistant Examiner*—Michael J. Milano
*Attorney, Agent, or Firm*—Robert E. Knechtel

[57] ABSTRACT

A revolving door including a plurality of door leaves extending radially outwardly from a center shaft in angularly spaced positions. The door leaves are mounted in a door opening for rotation about said center shaft by upper and lower bearing means. The door also includes upper and lower collapsing mechanisms which are adapted to normally maintain the door leaves in their radial positions, but to permit pivotal movement of each door leaf about the center shaft between its normal radial position and a collapsed position in the event that the door leaf is subjected to abnormal forces. One of the upper and/or lower collapsing mechanisms has associated with it a locking assembly having an electromagnet which normally is operated to prevent the collapsing mechanism from functioning so that the door leaves can be collapsed. In the event of an emergency situation, the locking assembly is easily and quickly rendered inoperable simply by de-energizing the electromagnet which, in turn, permits pivotal movement of the door leaves to their collapsed positions.

7 Claims, 4 Drawing Sheets

COLLAPSING MECHANISM FOR REVOLVING DOORS

This invention generally relates to collapsible revolving doors and, more specifically, it relates to an improved collapsing mechanism which permits the leaves of the door to be deliberately collapsed and which can be operated to effectively prevent the leaves from being collapsed.

Revolving doors generally comprise three or four leaves which are angularly spaced about a center shaft. The leaves all rotate together with the center shaft under normal operation. Most revolving doors also normally include a collapsing mechanism which permits the leaves to be collapsed flat against one another to allow people to pass straight through the door in the event of a fire or other emergency, thus providing a safety feature.

While existing collapsing mechanisms generally are satisfactory for their intended purposes, there are problems associated with the use of them. For example, the existing collapsing mechanisms generally are functional when the leaves are subject to abnormal forces which cause the collapsing mechanisms to release the leaves and permit them to be rotated about the center shaft so that the leaves can be collapsed flat against one another. Normally these abnormal forces are applied by individuals during an emergency situation to intentionally collapse the leaves so that they can exit through the revolving door. However, in many newer buildings, particularly highrises, it is found that wind tunnel-like effects, or vacuums, are created which are of sufficient strength that the door leaves are caused to collapse, or the door leaves collapse when an individual simply applies to the door leaves the force necessary to rotate the revolving door. Also, during the hours when the revolving doors are intended to operate to allow ingress and egress into and out of a building, the functioning of the collapsing mechanisms provide the safety feature they are intended to provide. However, during the hours that the revolving doors are secured to prevent ingress and egress into and out of the building, obviously some means must be provided to render the collapsing mechanisms inoperative so that the leaves cannot be collapsed flat against one another. In other words, the leaves must be locked so that people cannot enter or leave the building through the revolving door.

Various means have been devised to render the collapsing mechanism inoperative. In most cases, however, these means have been generally unsatisfactory, for one reason or another. For example, some of these means are functional to render the collapsing mechanisms inoperative to prevent the leaves from being collapsed, but they cannot be easily and quickly operated to restore operation of the collapsing mechanism in the case of a fire or other emergency. Others of these means can be easily and quickly operated but the mechanisms are unduly complex and expensive.

Also, in recent years, larger revolving doors having diameters of 10 feet or more have been built. These revolving doors obviously have larger leaves and, in many cases, the existing collapsing mechanisms cannot accommodate the higher turning moment produced when a person pushes on the leaf of such large diameter doors. Accordingly, the leaves collapse when they are not suppose to collapse. In order to prevent these leaves from collapsing, new collapsing mechanisms which will accommodate the higher turning moments must be provided or, alternatively, new means must be provided to render the collapsing mechanisms inoperative. In the latter event, provisions also must be made to quickly restore the operation of the collapsing mechanisms, in case of fire or other emergencies. The existing means for compensating for these higher turning moments and retaining the necessary safety feature of the revolving doors likewise are unduly complex and expensive.

Accordingly, it is an object of the invention to provide a collapsible revolving door having an improved collapsing mechanism for permitting the leaves of the door to collapse in an emergency situation and for permitting the leaves of the door to be effectively locked against collapsing, and at the same time, to permit them to be easily and quickly collapsed if desired or necessary.

The revolving door of the invention includes a plurality of door leaves extending radially outwardly from a center shaft in angularly spaced positions. The door leaves are mounted in a door opening for rotation about said center shaft by upper and lower bearing means. The door also includes upper and lower collapsing mechanisms which are adapted to normally maintain the door leaves in their radial positions, but to permit pivotal movement of each door leaf about the center shaft between its normal radial position and a collapsed position in the event that the door leaf is subjected to abnormal forces. One of the upper and/or lower collapsing mechanisms has associated with it a locking assembly having an electromagnet which normally is operated to prevent the collapsing mechanism from functioning so that the door leaves can be collapsed. In the event of an emergency situation, the locking assembly is easily and quickly rendered inoperable simply by de-energizing the electromagnet which, in turn, permits pivotal movement of the door leaves to their collapsed positions.

Other objects and features of the invention will be apparent from the description which follows, when taken in consideration with the drawings wherein.

Figure 1:
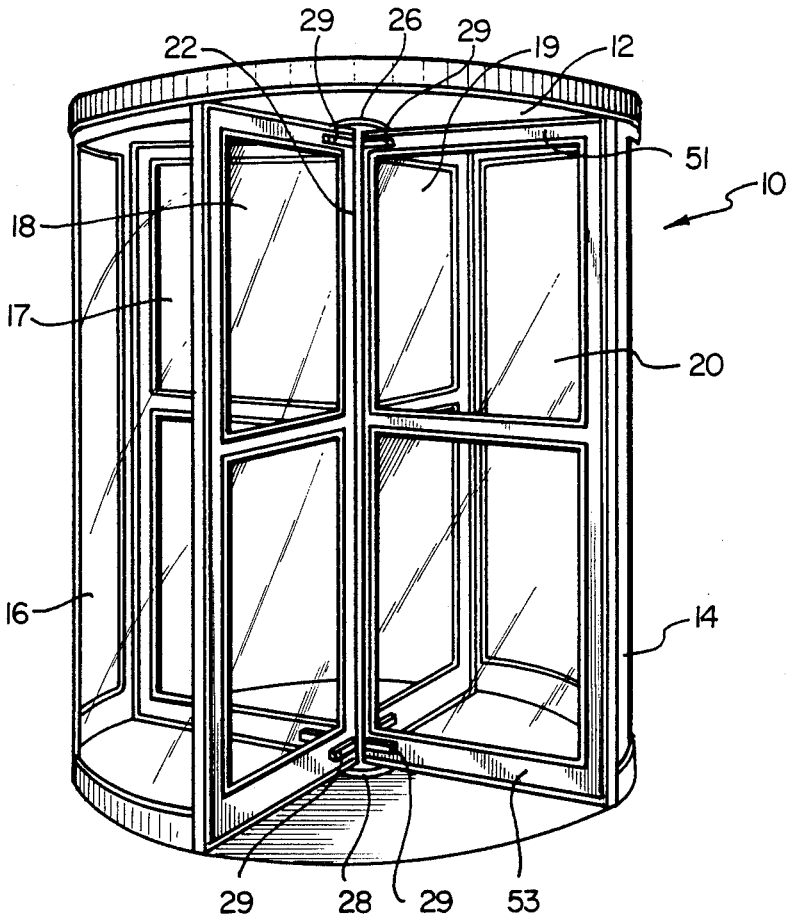
FIG. 1 is a perspective view of a revolving door exemplary of the invention.

Referring now to the drawings, in FIG. 1 there is illustrated a typical revolving door 10 including a ceiling structure 12 and curved walls 14 and 16. As illustrated, the revolving door 10 has four door leaves 17–20 which are affixed to and radiate outwardly in angularly spaced positions from a center shaft 22 to the walls 14 and 16. The center shaft 22 is vertically mounted for rotation by means of upper and lower bearing means generally indicated by the reference numerals 26 and 28, between the ceiling structure 12 and a floor structure 24. The upper and lower bearing means may be of the type conventionally used in revolving doors which are capable of supporting the weight of the door. Alternatively, as illustrated in FIG. 2, the upper ceiling mounted or lower floor mounted bearing means may be included as part of a motor and gear assembly 30 which functions to rotate and/or control the rotation of the revolving door 10.

Figures 2, 3:
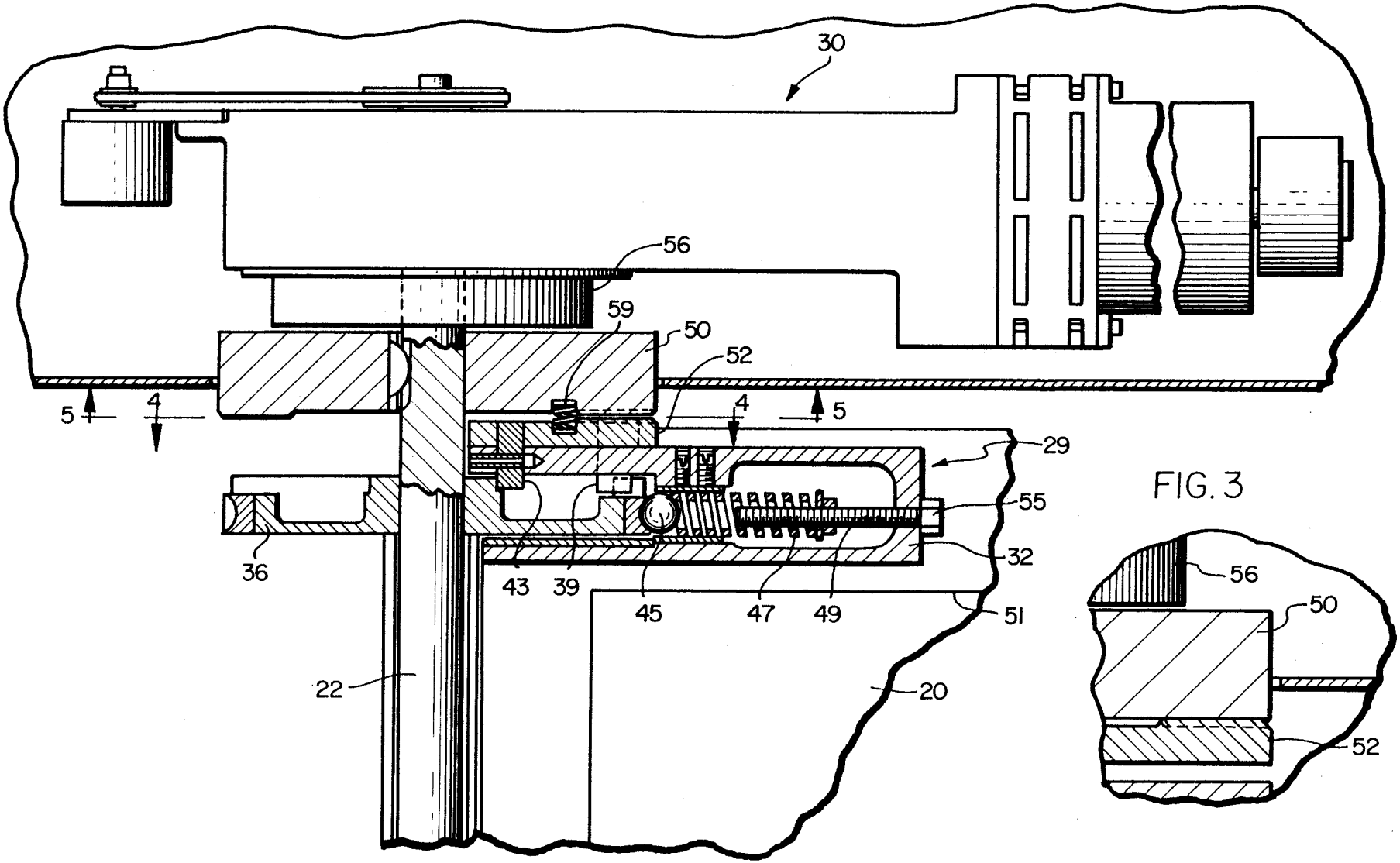
FIG. 2 is a side plan view, partially sectional, of the top collapsing mechanism of the revolving door of FIG. 1.
FIG. 3 is a partial sectional view illustrating the manner in which the interlocking means engage to render the collapsing mechanism inoperable.

The door leaves 17–20 each are identical, and are affixed at the upper and lower ends thereof to the center shaft 12 by means of hanger assemblies, such as the hanger assembly 29 illustrated in FIG. 2. The hanger assemblies 29 have incorporated therewith collapsing mechanisms 32 which normally maintain the door leaves 17–20 in the radial positions in which they are shown in FIG. 1, but permit each door leaf to pivot between its normal radial position and a collapsed position in the event that the door leaves are subject to abnormal forces such as would occur, for example, during a panic situation.

Figure 8:
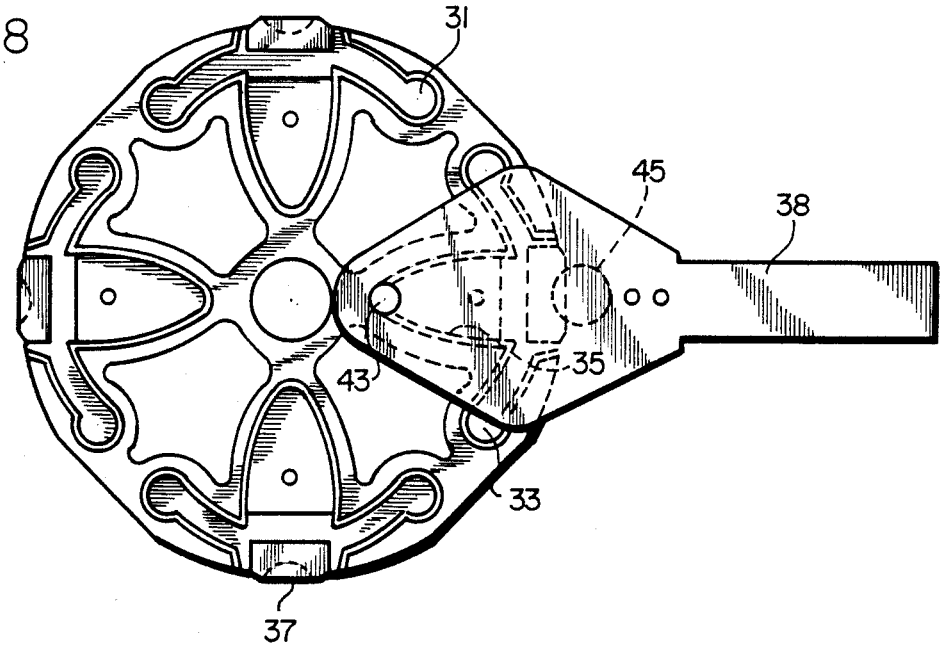
FIG. 8 is a top plan view illustrating a hanger assembly attached to the collapsing mechanism.

The hanger assemblies 29 and the collapsing mechanisms 32 are identical and, as can be best seen in FIG. 2, each includes a disc plate 36 which is affixed against rotation to the center shaft 22. The disc plates 36, as can be best seen in FIG. 8, are of a generally circular configuration and have for each door leaf which is to be affixed thereto a pair of opposed tracks 31 and 33 formed in them. Between these opposed tracks 31 and 33, there is provided another generally cone-shaped track 35. A ball detent cavity 37 is formed in the peripheral side wall of the disc plate 36 central of the cone-shaped track 35.

Figure 4:
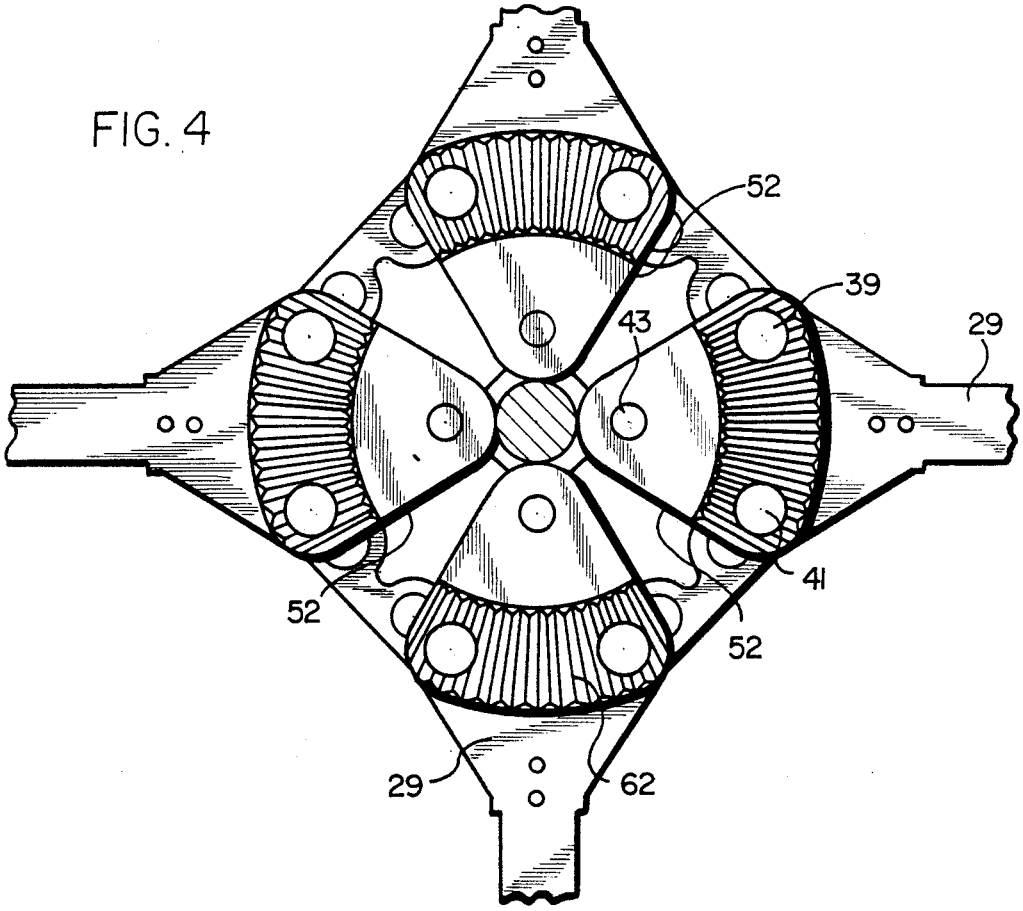
FIG. 4 is a partial top plan view of the hanger assembly.

The hanger assembly 29 for each door leaf, as can be best seen in FIGS. 2 and 4, has a pair of spaced-apart large pins 39 and 41, and a smaller pin 43. There also is a spring-loaded ball detent assembly including a ball 45, a spring 47 and a threaded screw 49.

The hanger assemblies 29 are affixed for pivotal rotation to the disc plate 36 by engaging the small pin 43 on them into the cone-shaped track 35 and the large pins 39 and 41 on them into the opposed tracks 31 and 33 in the disc plate. The threaded screw 49 then is adjusted by means of the nut 55 on its end to securely seat the ball 45 into the ball detent cavity 37 in the disc plate 36. The hanger assemblies 29 are affixed within the upper and lower frame members 51 and 53 of the door leaves 17–20 (as can be best seen in FIG. 2 wherein only one upper hanger assembly 29 is illustrated) thereby securing the door leaves to the disc plate 36 and hence the center shaft 22.

The operation of the collapsing mechanisms 32 is such that when an abnormal force is exerted against a door leaf, the ball 45 initially is displaced from the ball detent cavity 37 and the hanger 38 pivots about the small pin 43 in the cone-shaped track 35 until the large pin 39 engages the end of the track 31, or the large pin 41 engages the end of the track 33 depending upon which way the door leaf is pushed. When the large pin 39 engages the end of the track 31, the large pin 39 then functions as a pivot and the small pin 43 follows the contour of the cone-shaped track 35 permitting the door leaf to be folded to its collapsed position. Collapsing mechanisms of the described type are well known in the art, and have been manufactured and used by the assignee of the present invention on its revolving doors.

As indicated above, the functioning of the collapsing mechanisms provide the safety feature they are intended to provide, but some means to prevent the door leaves from being collapsed are now desirable. Otherwise, the door leaves may inadvertently collapse. Also, whatever the arrangement is to secure the door leaves to prevent them from inadvertently collapsing, the arrangement should be easily and quickly rendered inoperative so that the door leaves can be collapsed in the case of an emergency situation to permit people to exit through the revolving door.

Figure 5:
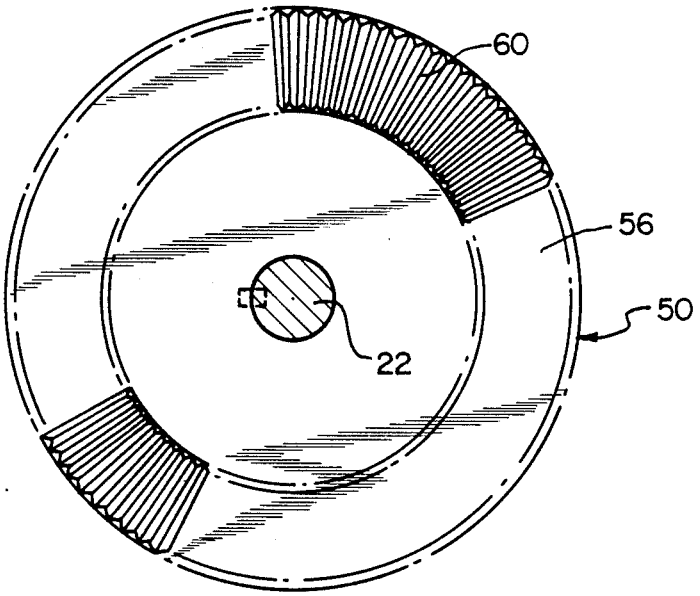
FIG. 5 is a plan view of the electromagnet of the locking assembly.

In accordance with the invention, this is accomplished by securing to the center shaft 22 an electromagnet 50 and, in accordance with a first embodiment of the invention, by securing to each of the upper ones of the hanger assemblies 29 a generally triangular-shaped pad 52. As can be best seen in FIGS. 4 and 5, the lower surface 56 (as shown) of the electromagnet 50 and the upper surface 58 (as shown) of each of the pads 52 have teeth 60 and 62 formed on them, respectively, such that the teeth 60 and 62 lockingly engage when the electromagnet 50 is energized, as more specifically described below. The teeth 60 on the lower surface 56 of the electromagnet 50 may be formed in a continuous circle around the periphery of the electromagnet as illustrated, or they may be formed on the electromagnet in spaced-apart quadrants such that the teeth 60 and 62 lockingly engage when the door leaves 17–20 are affixed in their normal positions to radiate outwardly in angularly spaced positions from the center shaft 22.

Figure 6:
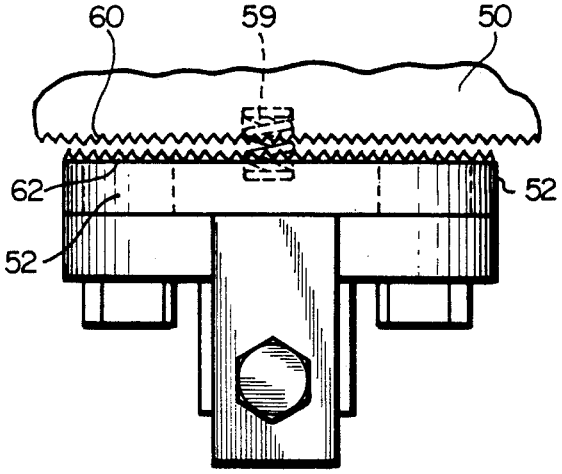
FIG. 6 is a side plan view of one embodiment of the locking assembly.

The pads 52 are secured to the hangers 32 by extending the length of the pins 39, 41 and 43 affixed to the hangers and by providing bores in the pads for slidably receiving therethrough the respective ones of these pins. The pads 52 therefore are secured against lateral movement to the hangers 32, but are free to move up and down on the pins 39, 41 and 43. As can be best seen in FIGS. 2 and 6, each of the pads 52 also has a spring-biasing arrangement 59 disposed within bores formed in the magnet 50 and the pads. The spring-biasing arrangements 59 function to disengage the teeth 60 and 62 on the electromagnet 50 and the pads 52 by forcing the pads 52 out of engagement with the electromagnet 50 when the latter is de-energized, thereby assuring that the door leaves can be collapsed.

Figure 7:
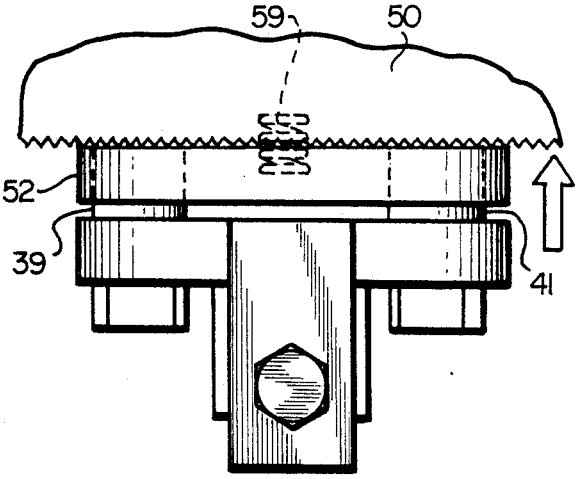
FIG. 7 is a side plan view of the locking assembly of FIG. 6 operated to prevent the doors from collapsing.

The collapsing mechanisms 34 are fully operational so that the door leaves 17–20 can be collapsed in the manner described above when an abnormal force is applied to them. However, for the reasons discussed above, during normal operation the electromagnet 50 is energized and each of the pads 52 is pulled upwardly as shown in FIG. 7, to mesh the teeth 62 with the teeth 60 on the electromagnet 50. When the teeth 62 and 60 are meshed, the hanger assemblies 29 are effectively locked in place, thus the collapse mechanism 34 is rendered inoperative and the door leaves are prevented from collapsing, even when an abnormal force is applied to them.

Should it be desired to permit the door leaves to be collapsed in, for example, an emergency situation, the electromagnet 50 simply is de-energized and the spring-biasing arrangements 59 force the pads to seat atop the hangers so that the teeth 60 and 62 are disengaged. Once the teeth 60 and 62 are disengaged, the door leaves can be collapsed by exerting an abnormal force against them.

Power is supplied to the electromagnet 50 from a source of power (not shown) through a slip ring assembly 56. Switch means (not shown) are included in the coupling between the source of power and the slip ring assembly for de-energizing the electromagnet 50, in the event of an emergency or the like. In addition, switch means can be incorporated into the building alarm system so that the electromagnet is automatically de-energized in the event of a fire alarm or the like, thereby permitting the door leaves to be moved to their collapsed positions.

Figure 9:
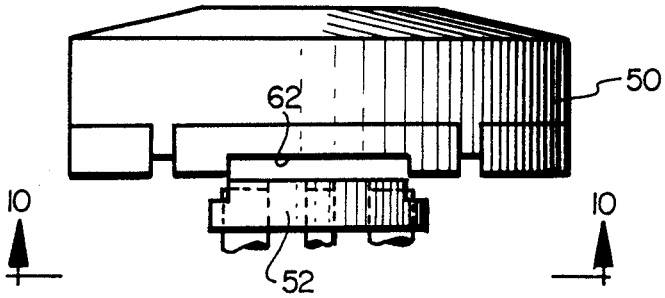
FIG. 9 is a partial side plan view of the locking assembly in accordance with a second embodiment of the invention.
Figure 11:
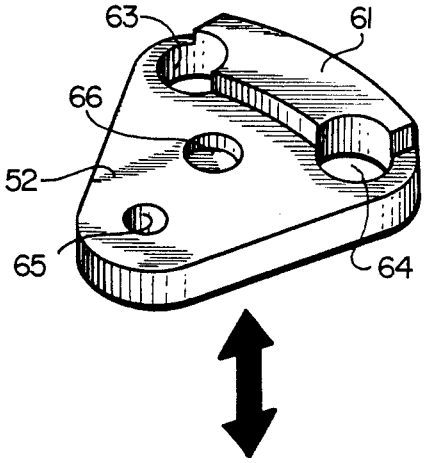
FIG. 11 is a perspective view of one of the interlocking means which are affixed to the collapsing mechanism.
Figure 10:
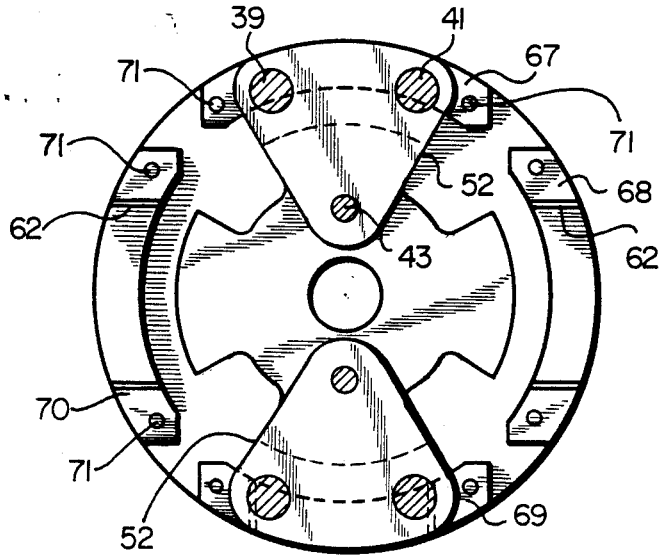
FIG. 10 is a plan view illustrating how two of the interlocking means of the locking assembly lockingly engage.

In FIGS. 9–11, there is illustrated another embodiment of the invention wherein the pads 52 affixed to the hanger assembly 29 instead of having teeth on them simply have a raised interlock portion 61 which seats within a cavity 62 in the magnet 50 which is correspondingly shaped to lockingly receive therein the raised portion 61 and thereby prevent the doors from being collapsed.

More particularly, as can be best seen in FIG. 11, the pads 52 are generally triangular shaped and have bores 63–65 through them for slidingly receiving therein the two large pins 38, 41 and the small pin 43 on the hanger assembly 29 so that the pads 52 can be raised to engage with the electromagnet 50 as described above. The pads 52 also have a cavity 66 for receiving therein the spring-biasing arrangement 59 which biases the pads 52 to seat atop the hanger assembly 29 when the electromagnet 50 is de-energized. As indicated above, instead of teeth, the pads 52 have formed on them a generally arcuate-shaped raised portion 61 which functions as one-half of the complimentary interlocking means, as more particularly described below.

As can be seen in FIGS. 9 and 10, assuming that the revolving door has four door leaves, four generally banana-shaped inserts 67–70 having cavities 62 in them which are proportionately sized and shaped to receive therein the raised portions 61 on the pads 52 are provided. These inserts 67–70 are removably secured by means of threaded screws 71 or the like into the electromagnet 50 in arcuately-spaced positions corresponding to the positions in which the door leaves normally radiate outwardly in angularly spaced positions from the center shaft 22 90° apart. The cavities 62 could be formed in the electromagnet 50, but it is preferred to provide removable inserts 67–70 so that the inserts can be easily removed and replaced if the cavities 62 are worn from extended use so that the pads 52 do not seat properly in the cavities.

In this embodiment, the electromagnet 50 is energized and each of the pads is pulled up and the raised interlock portions 61 on the pads 52 seat within the cavities 62 in the inserts 67–70 which are secured to the electromagnet 50. When the raised interlock portions 61 on the pads 52 are seated within the cavities 62, the hangers 32 are effectively locked in place, thus the collapsing mechanism 34 is rendered inoperative and the door leaves are prevented from collapsing. Should an emergency situation arise, the door leaves can be permitted to collapse simply by de-energizing the electromagnet 50, as described above.

Accordingly, from the above description, it can be seen that a collapsible revolving door having an improved collapsing mechanism for permitting the leaves of the door to collapse in an emergency situation and for permitting the leaves of the door to be effectively locked against collapsing is provided. Also, while two specific embodiments, one using teeth which mesh, and one with raised interlock portions and cavities, are illustrated, it is apparent that other types of complimentary interlocking means can be provided.

What is claimed is:

1. A collapsible revolving door comprising at least a pair of side walls forming a doorway, a vertically disposed center shaft mounted for rotation central of said doorway, a plurality of door leaves normally extending radially outwardly from said center shaft in angularly spaced positions, upper and lower collapsing mechanisms, each of said upper and lower collapsing mechanisms comprising a disc plate secured to said center shaft for rotation therewith and a plurality of hangers corresponding in number to the number of said door leaves, said hangers coupling said door leaves to said disc plate and adapted to normally maintain said door leaves in said radial positions but to permit pivotal movement of each door leaf about said center shaft between said normal radial position and a collapsed position in the event that the door leaf is subjected to abnormal forces, a locking assembly associated with at least one of said upper and lower collapsing mechanisms for preventing said collapsing mechanism from operating to permit pivotal movement of said door leaves about said center shaft, said locking assembly comprising an electromagnet secured to said center shaft for rotation therewith and disposed adjacent to said collapsing mechanism, a pad affixed to each of said hangers to which the door leaves which are to be secured against pivotal movement are affixed, said pads being moved up and down with respect to said hangers to engage said electromagnet, said pads and said electromagnet having thereon complimentary interlocking means which engage when said electromagnet is operated, said pads preventing the operation of said collapsing mechanism by preventing pivotal movement of said hangers and said door leaves about said center shaft when said interlocking means are engaged, and means for operating said electromagnet to move said pads to engage said interlocking means.

2. The collapsible revolving door of claim 1, wherein said electromagnet normally is energized so that said complimentary interlocking means are engaged and means for de-energizing said electromagnet.

3. The collapsible revolving door of claim 1, wherein said complimentary interlocking means comprise a plurality of teeth on each of said pads and on said electromagnet, respectively, said teeth being positioned so as to mesh when said electromagnet is operated.

4. The collapsing revolving door of claim 1, wherein said complimentary interlocking means comprise a plurality of cavities on said electromagnet, a raised interlock portion on each of said pads, said cavities and said raised interlock portions being positioned such that said raised interlock portions seat within said cavities when said electromagnet is operated.

5. The collapsible revolving door of claim 3, wherein said plurality of teeth on said electromagnet extend in a circle about the periphery of said electromagnet.

6. The collapsible revolving door of claim 5, wherein said plurality of teeth are spaced in angularly spaced positions about the periphery of said electromagnet, said angularly spaced positions corresponding to the positions of said plurality of doors extending radially outwardly from said center shaft.

7. The collapsible revolving door of claim 4, wherein said cavities are formed in inserts which are removably secured to said electromagnet.

* * * * *